US012313327B2

(12) United States Patent
Gomes

(10) Patent No.: US 12,313,327 B2
(45) Date of Patent: May 27, 2025

(54) REFRIGERATOR SYSTEM WITH MODULAR STRUCTURE

(71) Applicant: WHIRLPOOL CORPORATION, Benton Harbor, MI (US)

(72) Inventor: Alberto Regio Gomes, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 287 days.

(21) Appl. No.: 17/844,864

(22) Filed: Jun. 21, 2022

(65) Prior Publication Data

US 2023/0047846 A1 Feb. 16, 2023

Related U.S. Application Data

(60) Provisional application No. 63/232,442, filed on Aug. 12, 2021.

(51) Int. Cl.

| | |
|---|---|
| ***F25D 19/00*** | (2006.01) |
| ***F25D 11/00*** | (2006.01) |
| ***F25D 23/00*** | (2006.01) |
| ***F25D 23/06*** | (2006.01) |

(52) U.S. Cl.

CPC ..... *F25D 19/00* (2013.01); *F25D 11/00* (2013.01); *F25D 23/006* (2013.01); *F25D 23/065* (2013.01); *F25D 2400/16* (2013.01); *F25D 2500/02* (2013.01)

(58) Field of Classification Search

CPC ..... F25D 19/00; F25D 11/00; F25D 23/006; F25D 23/065; F25D 2400/16; F25D 2500/02; F25D 23/063; F25D 19/02

See application file for complete search history.

(56) References Cited

U.S. PATENT DOCUMENTS

| | | | | | |
|---|---|---|---|---|---|
| 2,678,544 | A * | 5/1954 | Sheidler | F25D 19/02 | 62/449 |
| 3,156,102 | A * | 11/1964 | Costantini | F25D 15/00 | 62/298 |
| 2008/0163628 | A1* | 7/2008 | Lilke | F25D 31/007 | 312/401 |
| 2012/0060525 | A1* | 3/2012 | Schork | F25B 49/02 | 62/507 |

FOREIGN PATENT DOCUMENTS

| | | | | |
|---|---|---|---|---|
| CN | 108626939 | A * | 10/2018 | F25D 11/02 |
| CN | 108626953 | A * | 10/2018 | F25D 17/065 |
| CN | 108626953 | B | 7/2021 | |
| JP | 2744146 | B2 * | 4/1998 | |
| JP | 2006308141 | A | 11/2006 | |
| KR | 970001293 | B1 * | 2/1997 | |
| WO | 2016118820 | A1 | 7/2016 | |

* cited by examiner

*Primary Examiner* — Kun Kai Ma
(74) *Attorney, Agent, or Firm* — Brooks Kushman P.C.

(57) ABSTRACT

A modular refrigerator system includes a modular cabinet and a machine housing. The modular cabinet comprises at least two sections that are secured to each other and collectively define an internal cavity configured to receive perishable foodstuffs or other items that may need to be refrigerated. The machine housing defines a machine compartment having a refrigeration circuit disposed therein. The refrigeration circuit has an evaporator and a condenser. The machine housing is secured to the modular cabinet and has an interface that establishes fluid communication with the internal cavity of the modular cabinet.

20 Claims, 4 Drawing Sheets

REFRIGERATOR SYSTEM WITH MODULAR STRUCTURE

CROSS-REFERENCE TO RELATED APPLICATIONS

This application claims the benefit of U.S. provisional application Ser. No. 63/232,442 filed Aug. 12, 2021, the disclosure of which is hereby incorporated in its entirety by reference herein.

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A modular refrigerator system includes a modular cabinet and a machine housing. The modular cabinet comprises at least two sections that are secured to each other and collectively define an internal cavity configured to receive perishable foodstuffs or other items that may need to be refrigerated. The machine housing defines a machine compartment having a refrigeration circuit disposed therein. The refrigeration circuit has an evaporator and a condenser. The machine housing is secured to the modular cabinet and has an interface that establishes fluid communication with the internal cavity of the modular cabinet.

A modular refrigerator system includes a modular cabinet and a machine housing. The modular cabinet has top, middle, and bottom stacked sections that are secured to each other and collectively define an internal cavity that is configured to receive and store foodstuffs. The machine housing is secured to the top stacked section on an opposing side of the middle stacked section or to the bottom stacked section on an opposing side of the middle stacked section. The machine housing defines a machine compartment having a refrigeration circuit disposed therein. The refrigeration circuit has an evaporator, a condenser, and a compressor. The machine housing has an interface that establishes fluid communication between the internal cavity and the machine compartment.

A modular refrigerator includes a modular cabinet and a machine housing. The modular cabinet has a plurality of stacked sections that are secured to each other and collectively define an internal cavity that is configured to receive and store foodstuffs. The machine housing is secured to an end section of the stacked sections. The machine housing defines a machine compartment having a refrigeration circuit disposed therein. The machine housing has an interface that establishes fluid communication between the internal cavity and the machine compartment.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
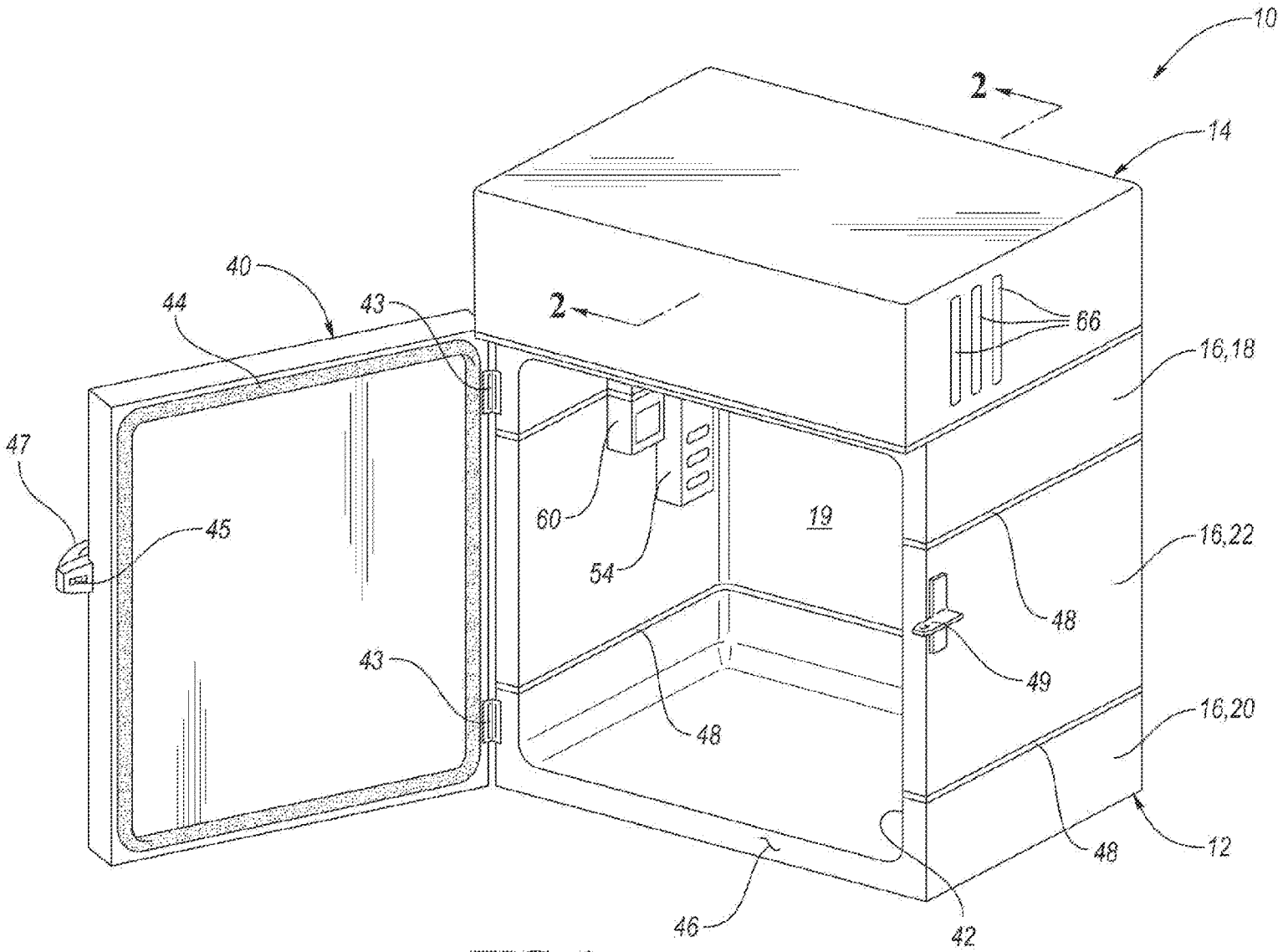
FIG. 1 is an isometric view of a modular refrigerator system.
Figure 2:
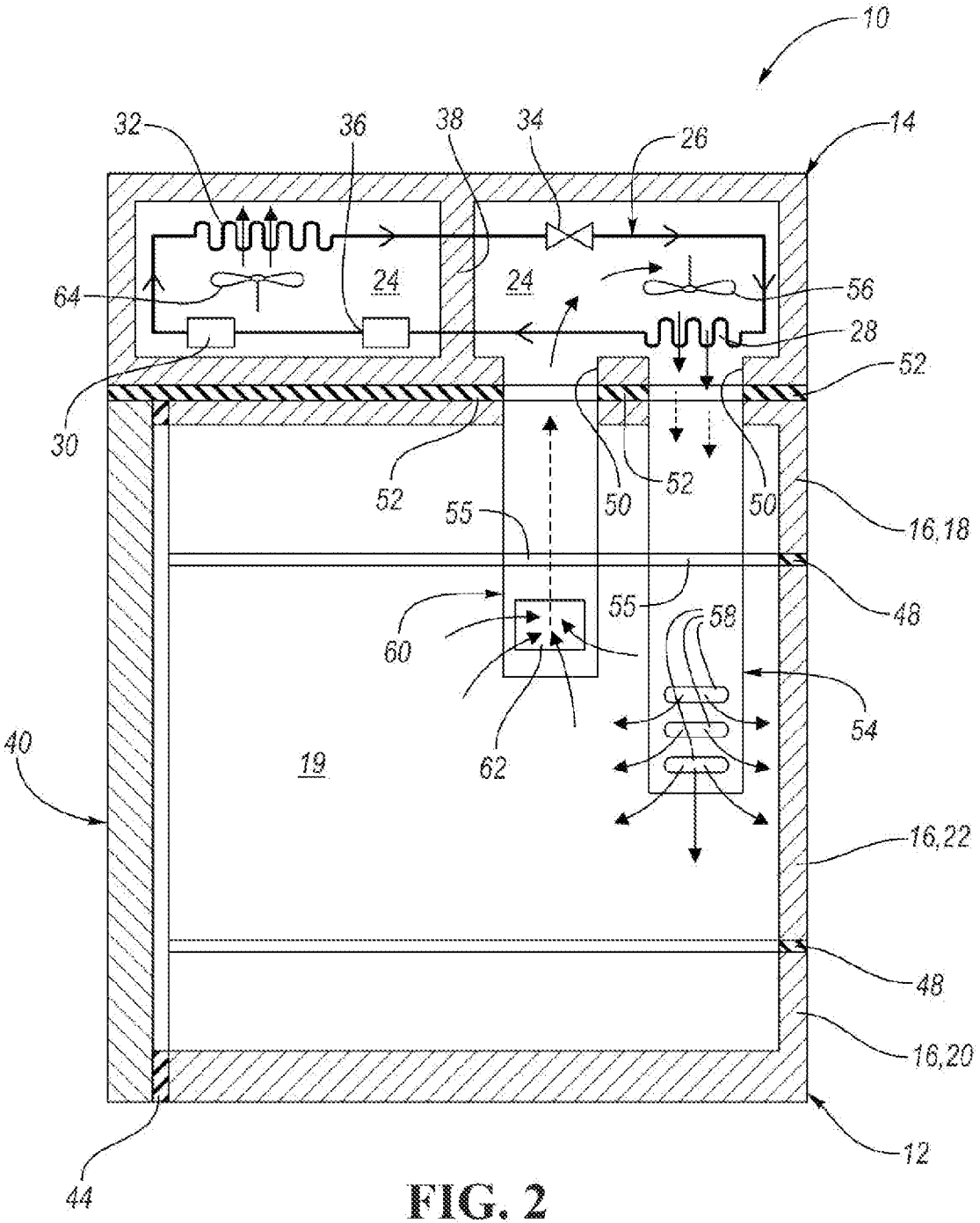
FIG. 2 is a cross-sectional view of the taken along line 2-2 in FIG. 1.
Figure 3:
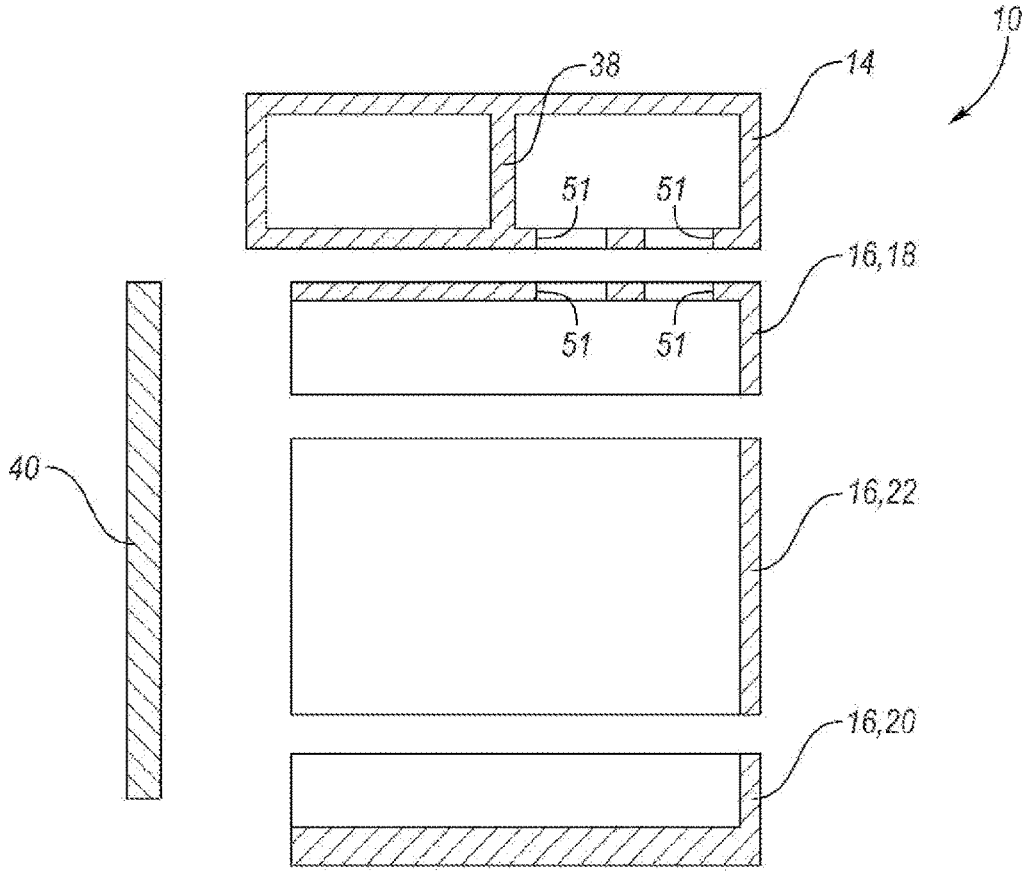
FIG. 3 is an exploded cross-sectional view of the taken along line 2-2 in FIG. 1.

Referring to FIGS. 1-3, a modular refrigerator system 10 is illustrated. The modular refrigerator system 10 includes a modular cabinet 12 and a machine housing 14. The modular cabinet 12 may be comprised of sections 16. The machine housing 14 and the sections 16 may be made from a rigid material such as a hard plastic or metal (e.g., stainless steel or aluminum). The sections 16 may be sequentially stacked one on top of another. In the illustrated example, the sections 16 comprise a first end section 18, a second end section 20, and a middle section 22. However, the modular cabinet 12 may include the first end section 18, the second end section 20, and any number of middle sections 22 (i.e., there may be zero, one, or any multiple number of middle sections 22). The first end section 18 may more specifically be referred to as the top section and the second end section 20 may more specifically be referred to as the bottom section. The adjacent sections of the sections 16 are secured to each other and collectively define an internal cavity 19 configured to receive perishable foodstuffs or other items that may need to be refrigerated.

The machine housing 14 is secured to at least one of the sections 16. More specifically, the machine housing 14 may be secured to a top of the first end section 18 forming a top of the refrigerator system 10. Alternatively, the machine housing 14 may be secured to the bottom of the second end section 20 forming a bottom of the refrigerator system 10. The machine housing 14 defines an internal cavity that may be referred to as the machine compartment 24. A refrigeration loop or circuit 26 is disposed within the machine compartment 24. The refrigeration circuit 26 is illustrated in diagrammatic form and the exact positions of the elements of the refrigeration circuit 26 should not be limited to what is illustrated in FIG. 2. The refrigeration circuit 26 may include an evaporator 28, a compressor 30, a condenser 32, a thermal expansion valve 34, and an accumulator 36. The machine housing 14 and the components disposed therein may be referred to as the cooling module.

The machine compartment 24 may be divided into two sub-compartments via a partition wall 38. Components of the refrigeration circuit 26 that reject heat (e.g., the condenser 32) and components of the refrigeration circuit 26 that generate heat (e.g., the compressor 30) may be disposed within the first of the two sub-compartments, which may be referred to as the hot side of the cooling module. Components of the refrigeration circuit 26 that absorb heat (e.g., the evaporator 28) may be disposed within the second of the two sub-compartments, which may be referred to as the cold side of the cooling module. In order to maximize the cooling output of the evaporator 28, components that reject or generate heat (e.g., the condenser 32 and the compressor 30) are segregated from the evaporator 28 via the partition wall 38.

The accumulator 36 is shown to be on the hot side of the cooling module since it will be at a higher temperature than the evaporator 28. This is because the refrigerant that is in the accumulator 36 had absorbed heat via the evaporator 28 immediately prior to entering the accumulator 36. The thermal expansion valve 34 is shown to be on the cold side of the cooling module since the output of the thermal expansion valve 34 with be at a lower temperature than the evaporator 28. However, the input of the thermal expansion valve 34 will be at a higher temperature than the evaporator 28, so the thermal expansion valve 34 may be relocated to the hot side of the cooling module or may have portions on the hot side of the cooling module and portions on the cold side of the cooling module.

The modular refrigerator system 10 further includes a door 40. The modular cabinet 12 collectively defines an opening 42 to the internal cavity 19. The door 40 provide access to the internal cavity 19 when in an open position (e.g., FIG. 1) and covers the internal cavity 19 when in a closed position (e.g., FIG. 2). A gasket or seal 44 may be disposed along an internal surface of the door 40 and may be configured to engage a front surface 46 of the modular cabinet 12 to prevent or inhibit fluid communication between the internal cavity 19 and the exterior of the modular refrigerator system 10 via the opening 42. The seal 44 may be made from an elastic material, such as a soft plastic or rubber. The door 40 and the seal 44 may each be single structures or may be comprised of stacked segments similar to the modular cabinet 12. If the door 40 and the seal 44 are single components, the door 40 and the seal 44 will need to be sized to fit the modular cabinet 12 depending on the number and size of the sections 16 forming the modular cabinet 12.

The door 40 may be rotatably secured to the modular cabinet 12 via hinges 43. A latching system may be configured to secure and lock the door 40 in the closed position. The latching system may include a latch 45, which is activated by a door handle 47, and striker 49. The latch 45 may engage an orifice defined by the striker 49 to the lock the door 40 in the closed position. Pulling on the handle may release the latch 45 from the striker 49, unlocking the door 40 and allowing the door 40 to transition to an open position.

The modular refrigerator system 10, or more specifically the modular cabinet 12, includes gaskets or seals 48 disposed between adjacent sections 16. The seals 48 may be made from an elastic material, such as a soft plastic or rubber. The seals 48 are configured to prevent or inhibit fluid communication between the internal cavity 19 and the exterior of the modular refrigerator system 10 via the spaces defined between adjacent sections 16.

The machine housing 12 is secured to the modular cabinet 12 and has an interface 50 that establishes fluid communication with the internal cavity 19 of the modular cabinet 12. The interface 50 may include at least one set of aligned openings 51 defined by the modular cabinet 12 and the machine housing 14. In the illustrated example, the modular refrigerator system 10 includes two sets of aligned openings 51 defined by the modular cabinet 12 and the machine housing 14. Additional gaskets or seals 52 may be disposed about each set of aligned openings 51 to prevent fluid communication between the interface 50 and the exterior of the modular refrigerator system 10. The seals 52 may be made from an elastic material, such as a soft plastic or rubber.

A first of the at least one set of aligned openings 51 is configured to deliver cold air from the machine compartment 24, and more specifically from the cold side of the cooling module, to the internal cavity 19. A first duct or conduit 54 may extend from the first of the at least one set of aligned openings 51 and into the internal cavity 19. The first duct or conduit 54 establishes fluid communication between the internal cavity 19 and the first of the at least one set of aligned openings 51. More specifically, the first duct or conduit 54 establishes fluid communication between the internal cavity 19 and machine compartment 24 via the first of the at least one set of aligned openings 51. The first of the at least one set of aligned openings 51 may be disposed on an output side of a first fan 56 that is configured to direct air across the evaporator 28 in order to cool the air before being delivered into the internal cavity 19. The first fan 56 may be referred to as the evaporator fan. The first duct or conduit 54 may define one or more openings 58 that allow the cooled air to flow out the first duct or conduit 54 and into the internal cavity 19. The openings 58 are defined toward a bottom of the first duct or conduit 54. However, the openings 58 may be defined at any position along the first duct or conduit 54.

The first duct or conduit 54 is illustrated as extending downward through two of the sections 16. However, the first duct or conduit 54 may extending downward into any number of sections 16, include one or all of the sections 16. The first duct or conduit 54 may be a single structure or may be comprised of stacked segments similar to the modular cabinet 12. If the first duct or conduit 54 is comprised of stacked segments, seals 55 may be disposed between adjacent segments to prevent air from leaking out of the first duct or conduit 54 prior to being delivered to the internal cavity 19 from the machine compartment 24. Also, if the first duct or conduit 54 is comprised of stacked segments, the segments of the first duct or conduit 54 may or may not be integral to correspond segments 16 of the modular cabinet 12.

A second of the at least one set of aligned openings 51 is configured to return air from the internal cavity 19 to machine compartment 24, and more specifically to the cold side of the cooling module. A second duct or conduit 60 may extend from the second of the at least one set of aligned openings 51 and into the internal cavity 19. The second duct or conduit 60 establishes fluid communication between the internal cavity 19 and the second of the at least one set of aligned openings 51. More specifically, the second duct or conduit 60 establishes fluid communication between the internal cavity 19 and machine compartment 24 via the second of the at least one set of aligned openings 51. The second of the at least one set of aligned openings 51 may be disposed on an input side of the first fan 56. The second duct or conduit 60 may define one or more openings 62 that allow air to flow into the second duct or conduit 60 from the internal cavity 19, which is then delivered to the machine compartment 24 via the second of the at least one set of aligned openings 51. The openings 62 are defined toward a bottom of the second duct or conduit 60. However, the openings 62 may be defined at any position along the second duct or conduit 60.

The second duct or conduit 60 is illustrated as extending downward through two of the sections 16. However, the second duct or conduit 60 may extending downward into any number of sections 16, include one or all of the sections 16. The second duct or conduit 60 may be a single structure or may be comprised of stacked segments similar to the modular cabinet 12. If the second duct or conduit 60 is comprised of stacked segments, seals 55 may be disposed between adjacent segments to prevent air from leaking out of the second duct or conduit 60 prior to being delivered to the machine compartment 24 from the internal cavity 19. Also, if the second duct or conduit 60 is comprised of stacked segments, the segments of the second duct or conduit 60 may or may not be integral to correspond segments 16 of the modular cabinet 12. Please note that no seals (e.g., seals 44, 48, and 52) are shown in FIG. 3 in order to simplify FIG. 3 for illustrative purposes.

The first duct or conduit 54 and the second duct or conduit 60 are both illustrated as being disposed along an internal side wall of the modular cabinet 12. However, it should be understood that the first duct or conduit 54 and the second duct or conduit 60 may be disposed along any wall within the modular cabinet 12, including a back wall, a first side wall, and a second side wall. Furthermore, the first duct or conduit 54 and the second duct or conduit 60 need not be disposed on the same side wall as illustrated.

A second fan 64 is configured to direct air across the condenser 32 to reject heat from the refrigerant within the refrigeration circuit 26 to an exterior of the modular refrigerator system 10. The second fan 64 may be referred to as the condenser fan 64. More specifically, the heat may be recovered and channeled to another device or system that requires heat via a duct or conduit, or the heat may be rejected by the second fan 64 blowing air across the condenser 32 and through openings 66 defined by the machine housing 14. Please note that the openings 66 are not limited to the shown position in FIG. 1 and may be relocated to any desired position on the machine housing 14, including a top surface, any of one of the several side surfaces, and a bottom surface (if the machine housing 14 is disposed below the sections 16) of the machine housing 14. The heat being rejected from the condenser 32 may comprise heat from the internal cavity which was transferred into the refrigerant of the refrigeration circuit 26 via the evaporator 28.

Figure 4:
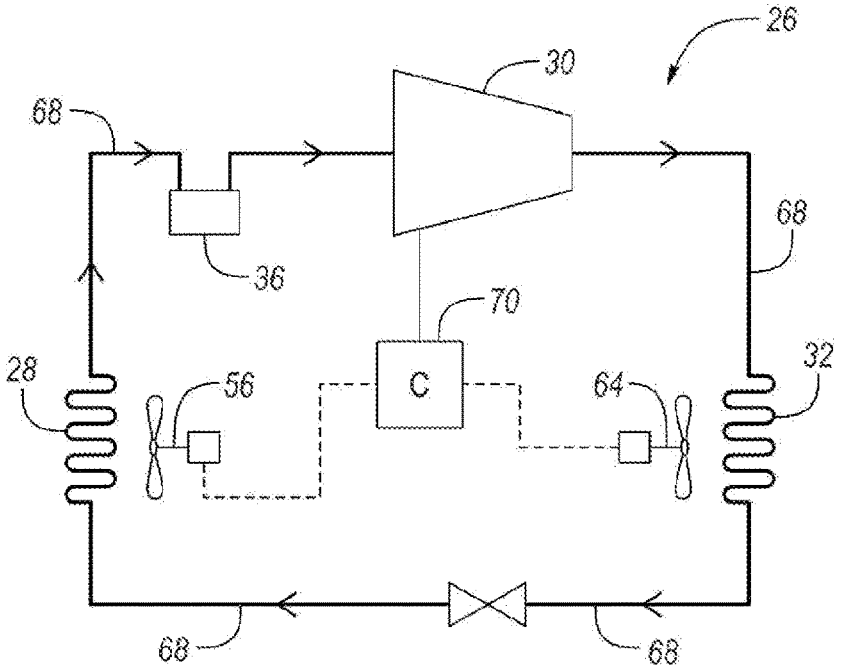
FIG. 4 is a diagram illustrating a refrigeration circuit.

Referring to FIG. 4, a diagram further illustrating the refrigeration circuit 26 of the modular refrigerator system 10 is illustrated. The refrigeration circuit 26 may include the evaporator 28, the compressor 30, the condenser 32, the thermal expansion valve 34, and the accumulator 36. The refrigeration circuit 26 includes lines or tubes 68 that are configured to transport the refrigerant between the evaporator 28, compressor 30, condenser 32, thermal expansion valve 34, and accumulator 36. The refrigerant within the refrigeration circuit 26 is converted from a low-pressure gaseous form to a high-pressure gaseous form within the compressor 30. The refrigerant is directed from the compressor 30 to the condenser 32. Heat may be transferred from the refrigerant to an external medium, such as air, via the condenser 32. The second fan 64 may be configured to direct air across the condenser 32 to transfer heat to the external medium.

The refrigerant then flows from the condenser 32 to the thermal expansion valve 34 where the pressure of the liquid refrigerant is reduced to allow the liquid refrigerant to expand, which decreases the temperature of the liquid refrigerant. The liquid refrigerant is then directed to the evaporator 28 where the refrigerant changes state from a liquid to a gas, which requires heat. The evaporator 28 transfers heat from an external source to the refrigerant. The first fan 56 may be configured to direct air across the evaporator 28 to transfer heat from the external source to the refrigerant. The external source of heat that the evaporator 28 draws heat from may be air that is being cooled and directed into the internal cavity 19 of the modular cabinet 12. The refrigerant then flows from the evaporator 28 to the accumulator 36, and from the accumulator 36 back to the compressor 30.

The compressor 30, fan 64, fan 56, and any other component may be powered by an electrical power source (not show), such as a battery or a power grid, and may be controlled by a controller 70, which also may be powered by an electrical power source, such as a battery or a power grid. More specifically, the compressor 30, fan 64, fan 56, and any other component may be operated by an electrical actuator, such an electric motor, which may be powered by the electrical power source and may be controlled by the controller 70. The controller 70 may be configured to automatically operate the compressor 30, fan 64, fan 56, or any other component based on an algorithm when specific conditions are present. Alternatively, or in addition to automatic operation, the controller 70 may be configured to operate the compressor 30, fan 64, fan 56, or any other component based on input from an operator (e.g., an operator using a control panel to initiate cooling air that is being introduced into the internal cavity 19).

More specifically, the controller 70 may be configured to control the speed of the compressor 30, fan 64, and/or fan 56 based on the cooling load of the modular refrigerator system 10. If the modular refrigerator system 10 requires additional cooling (e.g., if there is a large cooling load), the controller 70 may be configured to increase the speed of the compressor 30, fan 64, and/or fan 56. If the modular refrigerator system 10 requires less cooling (e.g., if there is a small cooling load), the controller 70 may be configured to decrease the speed of the compressor 30, fan 64, and/or fan 56. One or more temperature sensors may communicate the temperature within the internal cavity 19 to the controller 70. The required cooling load may increase as (i) a temperature differential between the temperature of the internal cavity 19 and a desired temperature of the internal cavity 19 increases and/or (ii) as a temperature differential between the temperature of the internal cavity 19 and a temperature of the ambient surroundings of the modular refrigerator system 10 increases. The temperature of the ambient surroundings may refer to the temperature of the air immediately surrounding the outside of the modular refrigerator system 10. The desired temperature may be preset into the controller 70 or may be set and adjusted by an operator via a control panel.

Furthermore, the cooling load may be adjusted by to account for the volume of the internal cavity 19, which depends on the number of sections 16 forming the modular cabinet 12. For example, if the modular cabinet 12 only includes the first end section 18 and the second end section 20, the volume will be lower relative to a modular cabinet 12 including the first end section 18, second end section 20, and one or more middle sections 22. As the volume increases, so will the required cooling load. The cooling load may be proportional to the volume. The cooling load adjustment to account for volume may be adjusted via an operator engaging a control panel that communicates with the controller 70 to make the adjustment, may be programmed into the controller 70 of a specific model once the number of sections 16 is selected, or the controller 70 may able to detect the number sections to automatically (e.g., a wired or wireless connection from each section may communicate the presence of each section to the controller so that the controller 70 knows the total volume of the internal cavity 19 and may adjust the cooling load to account for the total volume of the internal cavity 19).

The controller 70 may be part of a larger control system and may be controlled by various other controllers throughout modular refrigerator system 10. It should therefore be understood that the controller 70 and one or more other controllers can collectively be referred to as a "controller" that controls various actuators (e.g., motors powering the compressor 30, fan 64, and fan 56) in response to signals from various sensors or inputs (e.g., a sensor detecting temperature of the internal cavity 19, an input or sensed number of sections 16, etc.) to control various functions of the modular refrigerator system 10. The controller 70 may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller 70 in controlling the modular refrigerator system 10.

Figure 5A:
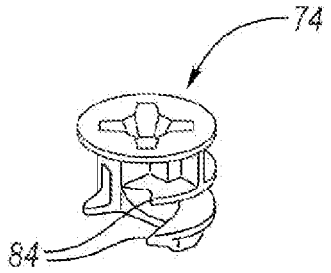
FIGS. 5A-5C illustrate a first system for connecting adjacent sections of the modular refrigerator system.
Figure 5B:
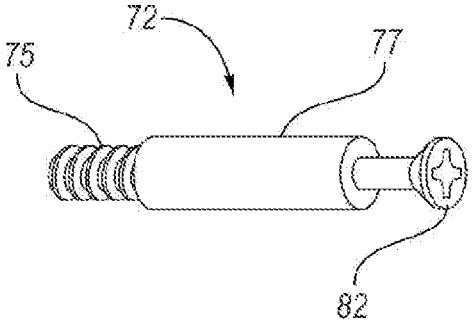
Figure 5C:
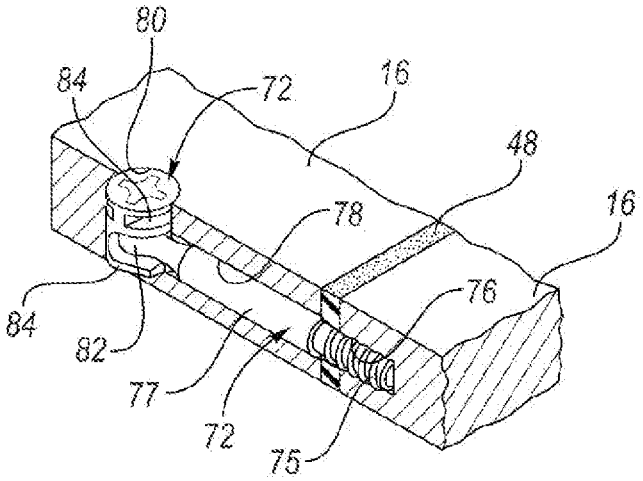

Referring to FIGS. 5A-5C, a first system for connecting adjacent sections 16 of the modular cabinet 12 of the modular refrigerator system 10 is illustrated. The first system for connecting adjacent sections 16 of the modular cabinet 12 includes a cam bolt 72 and a cam nut 74 that are configured to align and secure adjacent sections 16 to each other. The cam bolt 72 has a threaded portion 75 that engages a tapped hole 76 defined in a first of the adjacent sections 16. A non-threaded portion 77 of the cam bolt 72 extends into a hole 78 defined by a second of the adjacent sections 16. Hole 78 is aligned with tapped hole 76 once the threaded portion 75 of the cam bolt 72 engages the tapped hole 76 and once the non-threaded portion 77 of the cam bolt 72 is positioned within hole 78. The cam nut 74 is disposed with a second hole 80 defined by the second of the adjacent sections 16. The second hole 80 is substantially perpendicular to and intersects hole 78. Substantially perpendicular may refer to any incremental angle that ranges between exactly perpendicular and 15° from exactly perpendicular.

A head portion 82 of the cam bolt 72 extends from hole 78 and into the second hole 80 where the cam nut 74 engages the head portion 82. Once assembled, the cam nut 74 has claws 84 that grab onto the head portion 82 and pull cam bolt 72 toward the cam nut 74 generating a compression force between the first and second adjacent sections 16. The compression force ensures that the seals 48 are properly compressed, which prevents or inhibits fluid communication between the internal cavity 19 and the exterior of the modular refrigerator system 10. The seals 48 may more specifically form an airtight, watertight, and/or hermetic seal. The first system for connecting adjacent sections 16 of the modular cabinet 12 may include any number of cam bolt 72 and cam nut 74 combinations to align and secure the adjacent sections 16 to each other. More specifically, each adjacent wall (i.e., the back wall and two side walls) of adjacent sections 16 may include one or more of the cam bolt 72 and cam nut 74 combinations.

Figure 6:
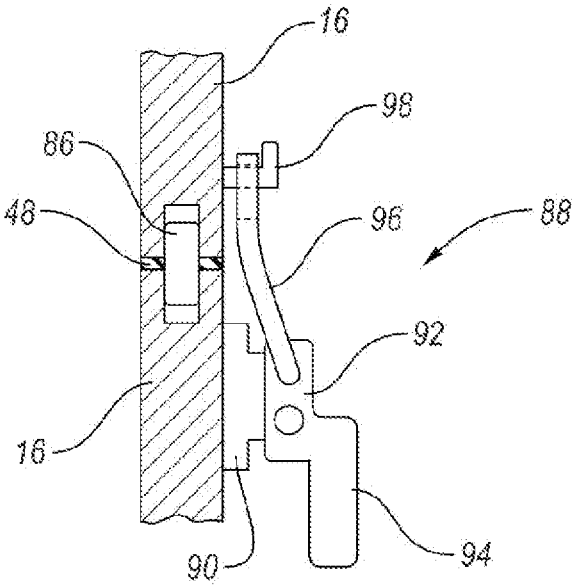
FIG. 6 illustrates a second system for connecting adjacent sections of the modular refrigerator system.

Referring to FIG. 6, a second system for connecting adjacent sections 16 of the modular cabinet 12 of the modular refrigerator system 10 is illustrated. The second system for connecting adjacent sections 16 of the modular cabinet 12 includes dowels 86 configured to align adjacent sections 16 and latches or clamps 88 that are configured secure the adjacent sections 16 to each other. The clamps 88 may include a base 90, a body 92 rotatably secured to the base 90, a handle 94 extending from the body, a loop or hook 96 rotatably secured to the body 92, and a catch 98. The catch 98 may also be a hook or may be L-shaped. The catch 98 is secured to a first of the adjacent sections 16 while the remainder of the clamp 88 is secured to the second of the adjacent sections 16 via the base 90.

The hook 96 engages the catch 98 when the adjacent sections 16 are secured to each other. More specifically, the body 92 is rotated toward the adjacent sections 16 via the handle 94 such that the hook 96 pulls on the catch 98 generating a compression force between the adjacent sections 16 in order to ensure that the seals 48 are properly compressed, which prevents or inhibits fluid communication between the internal cavity 19 and the exterior of the modular refrigerator system 10. The seals 48 may more specifically form an airtight, watertight, and/or hermetic seal. The second system for connecting adjacent sections 16 of the modular cabinet 12 may include any number of dowel 86 and clamp 88 combinations. More specifically, adjacent sections 16 may include two dowels 86 to provide proper alignment between the adjacent sections 16 and adjacent walls (i.e., the back wall and two side walls) of adjacent sections 16 may include one or more clamps 88 to secure the adjacent sections 16 to each other.

It should be noted that the machine housing 14 may be secured to one of the sections 16 in any manner described herein relative to how the adjacent sections 16 are secured to each other. Furthermore, the housing 14 and the adjacent sections 16 may be secured to each other in any manner know to a person of ordinary skill in the art. It should be understood that the designations of first, second, third, fourth, etc. for any component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A modular refrigerator system comprising:

a modular cabinet comprising at least two sections that are secured to each other and collectively define an internal cavity configured to receive perishable foodstuffs or other items that may need to be refrigerated, wherein each of the at least two sections (i) has a back wall, (ii) has first and second side walls extending forward from opposing sides of the corresponding back wall, and (iii) defines an open forward end extending between the corresponding first and second side walls on an opposing side of the corresponding first and second side walls relative to the corresponding back wall, wherein the internal cavity extends (a) between the first and second side walls of each of the at least two sections, (b) between the back walls and the open forward ends of each of the at least two sections, and (c) between a top wall of an uppermost of the at least two sections and a bottom wall of the lowermost of the at least two sections, and wherein the open forward ends of each of the least two sections collectively define an opening to the internal cavity where the opening is (I) continuous between the first and second side walls of each of the at least two sections and (II) continuous between the top wall of the uppermost of the at least two sections and the bottom wall of the lowermost of the at least two sections; and a machine housing defining a machine compartment having a refrigeration circuit disposed therein, the refrigeration circuit having an evaporator and a condenser, wherein the machine housing is secured to the modular cabinet and has an interface that establishes fluid communication with the internal cavity of the modular cabinet, wherein the interface includes at least one set of aligned openings defined by the modular cabinet and the machine housing.

2. The modular refrigerator system of claim 1 further comprising seals disposed about the at least one set of aligned openings to prevent fluid communication between the interface and an exterior of the modular refrigerator system.

3. The modular refrigerator system of claim 1, wherein a first of the at least one set of aligned openings is configured to deliver cold air from the machine compartment to the internal cavity, a second of the at least one set of aligned openings is configured to return air from the internal cavity to machine compartment, and further comprising first and second conduits that (i) extend into the internal cavity and (ii) establish fluid communication between the first and second of the at least one set of aligned openings and the internal cavity, respectively, wherein (a) the first conduit defines an outlet opening within the internal cavity, (b) the second conduit defines an inlet opening within the internal cavity, and (c) outlet opening is vertically offset from the inlet opening within the internal cavity.

4. The modular refrigerator system of claim 1 further comprising (i) seals disposed between adjacent sections of the at least two sections, (ii) dowels configured to align adjacent sections of the at least two sections, and (iii) clamps configured secure the adjacent sections of the at least two sections to each other and generate a compression force between the adjacent sections of the at least two sections to compress the seals, wherein (a) the first side wall, the second side wall, or the back wall of the adjacent sections define aligned orifices and (b) each dowel extends into one of the aligned orifices defined in a first of the adjacent sections, through a corresponding seal, and into one of the aligned orifices defined in a second of the adjacent sections.

5. The modular refrigerator system of claim 1 further comprising seals disposed between adjacent sections of the at least two sections, cam bolts, and cam nuts, wherein the cam bolts are configured to engage the cam nuts to (i) align adjacent sections of the at least two sections, (ii) secure the adjacent sections of the at least two sections to each other, and (iii) generate a compression force between the adjacent sections of the at least two to compress the seals, wherein (a) the first side wall, the second side wall, or the back wall of the adjacent sections define aligned orifices and (b) each cam bolt extends into one of the aligned orifices defined in a first of the adjacent sections, through a corresponding seal, and into one of the aligned orifices defined in a second of the adjacent sections.

6. The modular refrigerator system of claim 1, wherein the machine housing is secured to an end section of the at least two sections.

7. The modular refrigerator system of claim 1 further comprising a single door disposed over an entirety of the opening to the internal cavity.

8. The modular refrigerator system of claim 1, wherein the machine housing includes a partition wall that segregates the evaporator from the condenser.

9. The modular refrigerator system of claim 1 further comprising (i) an evaporator fan configured to direct air across the evaporator and into the internal cavity via the interface and (ii) a condenser fan configured to direct air across the condenser to reject heat from the internal cavity, (iii) a compressor configured to compress a refrigerant with the refrigeration circuit, (iv) and a controller, wherein the controller is programmed to, to control (a) a speed of the evaporator fan based on a cooling load, (b) a speed of the condenser fan based on the cooling load, and (c) a speed of the compressor based on the cooling load.

10. The modular refrigerator system of claim 3, wherein a second of the at least one set of aligned openings is configured to return air from the internal cavity to machine compartment.

11. The modular refrigerator system of claim 10 further comprising first and second conduits that (i) extend into the internal cavity and (ii) establish fluid communication between the first and second of the at least one set of aligned openings and the internal cavity.

12. A modular refrigerator system comprising:

a modular cabinet having top, middle, and bottom stacked sections that are secured to each other and collectively define an internal cavity that is configured to receive and store foodstuffs, wherein each of the top, middle, and bottom stacked sections (i) has a back wall, (ii) has first and second side walls extending forward from opposing sides of the corresponding back wall, and (iii) defines an open forward end extending between the corresponding first and second side walls on an opposing side of the corresponding first and second side walls relative to the corresponding back wall, wherein the internal cavity extends (a) between the first and second side walls of each of the top, middle, and bottom stacked sections, (b) between the back walls and the open forward ends of each of the top, middle, and bottom stacked sections, and (c) between a top wall of the top stacked section and a bottom wall of the bottom stacked section, and wherein the open forward ends of each of the top, middle, and bottom stacked sections collectively define an opening to the internal cavity where the opening is (I) continuous between the first and second side walls of each of the top, middle, and bottom stacked sections and (II) continuous between the top wall of the top stacked section and the bottom wall of the bottom stacked section;

a machine housing secured (i) to the top stacked section on an opposing side of the middle stacked section or (ii) to the bottom stacked section on an opposing side of the middle stacked section, wherein (a) the machine housing defines a machine compartment having a refrigeration circuit disposed therein, (b) the refrigeration circuit has an evaporator, a condenser, and a compressor, and (c) the machine housing has an interface that establishes fluid communication between the internal cavity and the machine compartment; and a single door disposed over an entirety of the opening to the internal cavity.

13. The modular refrigerator system of claim 12, wherein the interface includes at least one set of aligned openings defined by the modular cabinet and the machine housing.

14. The modular refrigerator system of claim 13 further comprising seals disposed about the at least one set of aligned openings to prevent fluid communication between the interface and an exterior of the modular refrigerator system.

15. The modular refrigerator system of claim 13, wherein (i) a first of the at least one set of aligned openings is configured to deliver cold air from the machine compartment to the internal cavity, and (ii) a second of the at least one set of aligned openings is configured to return air from the internal cavity to machine compartment, and further comprising first and second conduits that (i) extend into the internal cavity and (ii) establish fluid communication between the first and second of the at least one set of aligned openings and the internal cavity, respectively, wherein (a) the first conduit defines an outlet opening within the internal cavity, (b) the second conduit defines an inlet opening within the internal cavity, and (c) outlet opening is vertically offset from the inlet opening within the internal cavity.

16. The modular refrigerator system of claim 12 further comprising (i) seals disposed between adjacent sections of the top, middle, and bottom stacked sections, (ii) dowels configured to align adjacent sections of the top, middle, and bottom stacked sections, and (iii) clamps configured secure the adjacent sections of the top, middle, and bottom stacked sections to each other and generate a compression force between the adjacent sections of the top, middle, and bottom stacked sections to compress the seals, wherein (a) the first side wall, the second side wall, or the back wall of the adjacent sections define aligned orifices and (b) each dowel extends into one of the aligned orifices defined in a first of the adjacent sections, through a corresponding seal, and into one of the aligned orifices defined in a second of the adjacent sections.

17. The modular refrigerator system of claim 12 further comprising seals disposed between adjacent sections of the top, middle, and bottom stacked sections, cam bolts, and cam nuts, wherein the cam bolts are configured to engage the cam nuts to (i) align adjacent sections of the top, middle, and bottom stacked sections, (ii) secure the adjacent sections of the top, middle, and bottom stacked sections to each other, and (iii) generate a compression force between the adjacent sections of the top, middle, and bottom stacked sections to compress the seals, wherein (a) the first side wall, the second side wall, or the back wall of the adjacent sections define aligned orifices and (b) each cam bolt extends into one of the aligned orifices defined in a first of the adjacent sections, through a corresponding seal, and into one of the aligned orifices defined in a second of the adjacent sections.

18. The modular refrigerator system of claim 12, wherein the machine housing includes a partition wall that segregates the evaporator from the condenser and the compressor.

19. A modular refrigerator comprising:

a modular cabinet having a plurality of stacked sections that are secured to each other and collectively define an internal cavity that is configured to receive and store foodstuffs, wherein each of the stacked sections (i) has a back wall, (ii) has first and second side walls extending forward from opposing sides of the corresponding back wall, and (ii) defines an open forward end extending between the corresponding first and second side walls on an opposing side of the corresponding first and second side walls relative to the corresponding back wall, wherein the internal cavity extends (a) between the first and second side walls of each of the stacked sections, (b) between the back walls and the open forward ends of each of the stacked sections, and (c) between a top wall of an uppermost of the stacked sections and a bottom wall of the lowermost of the stacked sections, and wherein the open forward ends of each of the stacked sections collectively define an opening to the internal cavity where the opening is (I) continuous between the first and second side walls of each of the stacked sections and (II) continuous between the top wall of the uppermost of the stacked sections and the bottom wall of the lowermost of the stacked sections;

a machine housing secured to an end section of the stacked sections, wherein (i) the machine housing (i) defines a machine compartment having a refrigeration circuit disposed therein and (ii) has an interface that establishes fluid communication between the internal cavity and the machine compartment; and a single door disposed over an entirety of the opening to the internal cavity.

20. The modular refrigerator of claim 19 further comprising (i) seals disposed between adjacent sections of the stacked sections, (ii) dowels configured to align adjacent sections of the stacked sections, and (ii) clamps configured secure the adjacent sections of the stacked sections to each other and generate a compression force between the adjacent sections of stacked sections to compress the seals, wherein (a) the first side wall, the second side wall, or the back wall of the adjacent sections define aligned orifices and (b) each dowel extends into one of the aligned orifices defined in a first of the adjacent sections, through a corresponding seal, and into one of the aligned orifices defined in a second of the adjacent sections.

* * * * *